US009854902B1

(12) United States Patent
Remmey

(10) Patent No.: US 9,854,902 B1
(45) Date of Patent: Jan. 2, 2018

(54) BROOM SKIRT

(71) Applicant: Wishing You Well Products, Inc., Greensboro, NC (US)

(72) Inventor: Theresa F. Remmey, Greensboro, NC (US)

(73) Assignee: Wishing You Well Products, Inc., Greensboro, NC (US)

( * ) Notice: Subject to any disclaimer, the term of this patent is extended or adjusted under 35 U.S.C. 154(b) by 875 days.

(21) Appl. No.: 14/071,836

(22) Filed: Nov. 5, 2013

Related U.S. Application Data

(63) Continuation-in-part of application No. 13/753,905, filed on Jan. 30, 2013, now Pat. No. 9,345,315.

(51) Int. Cl.
*A47L 17/04* (2006.01)
*A46B 17/04* (2006.01)

(52) U.S. Cl.
CPC ..... *A46B 17/04* (2013.01)

(58) Field of Classification Search
CPC ... A46B 17/00; A46B 17/04; A46B 2200/302; A46B 2200/3026; A46B 2200/3033; A47L 13/44
USPC ..... 15/231, 246, 247
See application file for complete search history.

(56) References Cited

U.S. PATENT DOCUMENTS

| | | | | |
|---|---|---|---|---|
| 1,360,926 | A | 11/1920 | Glenn | |
| 1,617,764 | A | 2/1927 | Lawrence | |
| 2,320,372 | A | 6/1943 | McCarthy | |
| 2,446,814 | A * | 8/1948 | Crofton | A46B 17/00 15/247 |
| 2,963,731 | A | 12/1960 | Hoots | |
| 3,230,565 | A * | 1/1966 | Koch | A47L 13/44 15/145 |
| 3,956,155 | A | 5/1976 | Schwuger | 252/91 |
| 4,114,224 | A | 9/1978 | Disko | 15/229 A |
| 4,685,167 | A * | 8/1987 | Murray | A47L 13/24 15/147.1 |
| 4,961,242 | A | 10/1990 | Kresse et al. | 15/228 |
| 5,086,543 | A | 2/1992 | Mitchell | 24/16 PB |
| 5,419,015 | A | 5/1995 | Garcia | 15/228 |
| 6,389,637 | B1 | 5/2002 | Hurell | 15/247 |
| 6,681,434 | B2 | 1/2004 | Smith | 15/104.93 |
| 6,701,567 | B2 | 3/2004 | Smith | 15/247 |
| 7,624,468 | B2 | 12/2009 | Reddy et al. | 15/104.94 |
| 8,267,607 | B2 | 9/2012 | Harris | 401/139 |
| 9,345,315 | B1 * | 5/2016 | Remmey | A46B 17/04 |

(Continued)

OTHER PUBLICATIONS

Wikipedia.org entry in Polar Fleece as of Dec. 26, 2012.

*Primary Examiner* — Laura C Guidotti
(74) *Attorney, Agent, or Firm* — Tuggle Duggins P.A.; Blake Hurt

(57) ABSTRACT

A skirt for a broom that has a handle, a head and bristles extending from the head with a connector on the head includes a fabric having properties selected to be attractive to dirt. The fabric has a size at least twice the area of one major face of the bristles of the broom and has connectors complementary to the connectors on the broom head, so the fabric may be wrapped over the bristles and fastened to the broom head by engagement of the fabric connectors with the connectors on the broom head. The connectors on the skirt are typically "loop-type" hook and loop fasteners, so they can engage "hook-type" hook and loop fasteners on the broom head.

7 Claims, 11 Drawing Sheets

(56) References Cited

U.S. PATENT DOCUMENTS

| | | | | |
|---|---|---|---|---|
| 2005/0000050 | A1 | 1/2005 | Galvin et al. | 15/226 |
| 2005/0235446 | A1* | 10/2005 | Eggers | A47L 11/162 15/220.1 |
| 2009/0320229 | A1 | 12/2009 | Chen | 15/229.1 |
| 2011/0146018 | A1* | 6/2011 | Vasilakes | A47L 13/11 15/231 |

* cited by examiner

BROOM SKIRT

This non-provisional patent application claims all benefits under 35 U.S.C. §119(e) of U.S. non-provisional patent application Ser. No. 13/753,905 filed 30 Jan. 2013, now U.S. Pat. No. 9,345,315 issued 24 May 2016, entitled "Broom Skirt", in the United States Patent and Trademark Office, which is incorporated by reference in its entirety herein.

BACKGROUND OF THE INVENTION

Brooms have been known for centuries as very useful cleaning tools. They provide relatively stiff and rigid bristles mounted in a head and, in most instances, a long handle is applied to the head. This allows a person to stand and manipulate the handle, thereby causing movement of the bristles over a floor or other (lower) or (upper) surfaces. The resilience of the bristles provides a springiness to the motion, allowing dirt and debris on a floor to be thrown by the springiness of the bristles or the movement of the broom altogether toward a gathering place where they can be picked up or simply swept out the door. Brooms work reasonably well for loose, large debris that has some heft and density, but do not work well for dust or other more light weight forms of dirt.

There have been efforts made to provide attachments to brooms to assist them in attacking different kinds of dirt, but none have been simple, effective, and low cost as those devised by applicant. In a prior application Ser. No. 13/753,905 filed Jan. 30, 2013, applicant disclosed a broom skirt useful for adding to the functionality of a broom. Additional embodiments and functionalities are disclosed herein.

SUMMARY OF THE INVENTION

This application discloses a skirt for a broom that has a handle, a head and bristles extending from the head with a connector on the head. The skirt includes a fabric having properties selected to be attractive to dirt, the fabric having a size at least twice the area of one major face of the bristles of the broom and having connectors complementary to the connectors on the broom head. The fabric is wrapped over the bristles and fastened to the broom head by engagement of the fabric connectors with the connectors on the broom head.

The connectors on the skirt are typically "loop-type" hook and loop fasteners, so they can engage "hook-type" hook and loop fasteners on the broom head. The loop-type connectors may be positioned in a strip extending beyond an edge of the fabric by at least 6 inches, permitting connection of the loop-type connector to the hook-type connector on the broom head at a variety of positions, enabling positioning of a variety of parts of the skirt at bristle ends. The fabric is typically predominantly four-sided and the loop-type connector extends over areas along opposite edges of the fabric. The fabric may have slits in a central area, the slits being generally perpendicular to the areas with loop-type connector.

In another version, the fabric is wider than the broom head, enabling wrapping of the fabric around the broom head. The connectors on the skirt are "loop-type" hook and loop fasteners, so they can engage "hook-type" hook and loop fasteners on the broom head. The loop-type connectors are positioned in a strip extending beyond an edge of the fabric, and additional loop-type connectors extends along an edge of the fabric. The fabric may be two-ply.

In another version, a strip of hook-type connector extends from one end of the fabric on an opposite side from the loop-type connector strip that extend along and edge of the fabric, so that when the skirt is wrapped, the hook-type connector on the skirt can connect with the loop-type connector on the fabric edge.

The fabric is preferably selected from the group consisting of polar fleece, a microfiber terrycloth fabric made of 52% biconstituent Fiber (80% polyester, 20% nylon) and 48% polyester, and a synthetic chamois made of 70% viscose and 30% synthetic.

This application also discloses a broom for use with a skirt including a handle, a head and bristles extending from the head, with a connector on the head configured to engage with a skirt.

The head may be a plastic body having opposed sidewalls and a top wall, and the connector on the head may be an array of hook-type hook and loop fastener material on the sidewalls. Typically, the connector on the head also includes an array of hook-type hook and loop fastener material on the top wall.

In another embodiment, the head is a plastic body having opposed sidewalls and a top wall, and the connector on the head comprises at least one receiver including an irregular cut gripper, which defines tabs, enabling edges of skirt to be pressed into the grippers to hold the edges and retain the skirt to the head.

Typically the plastic body of the broom is smooth, in some embodiments of the invention, the molded plastic of the broom body is molded to have the hooks already, so no later addition of the tape is needed.

In addition, if a Swiffer or other disposable type cloth is added to the broom with hook type material on the head, the cloth will adhere to the hook material without the addition of loop type material.

The invention can also be considered as a cleaning kit a broom and at least one sheet of fabric. The broom includes a handle, a head and bristles extending from the head, with a connector on the head configured to engage with the fabric. The fabric has properties selected to be attractive to dirt, the fabric having a size at least twice the area of one major face of the bristles of the broom and having connectors complementary to the connectors on the broom head, so the fabric may be wrapped over the bristles and fastened to the broom head by engagement of the fabric connectors with the connectors on the broom head.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

As reported in Wikipedia, Polar fleece, usually referred to simply as "fleece," is a soft, napped, insulating synthetic fabric made from Polyethylene terephthalate (PET) or other synthetic fibers. The preferred fleece is 100% polyethylene terephthalate (colloquially known as polyester). One of the first forms was Polar Fleece, created in 1979 by Malden Mills, now Polartec LLC.; a new, light and strong pile fabric meant to mimic and in some ways surpass wool. Polar fleece has some of wool's finest qualities but weighs a fraction of the lightest available woolens.

Figure 1:
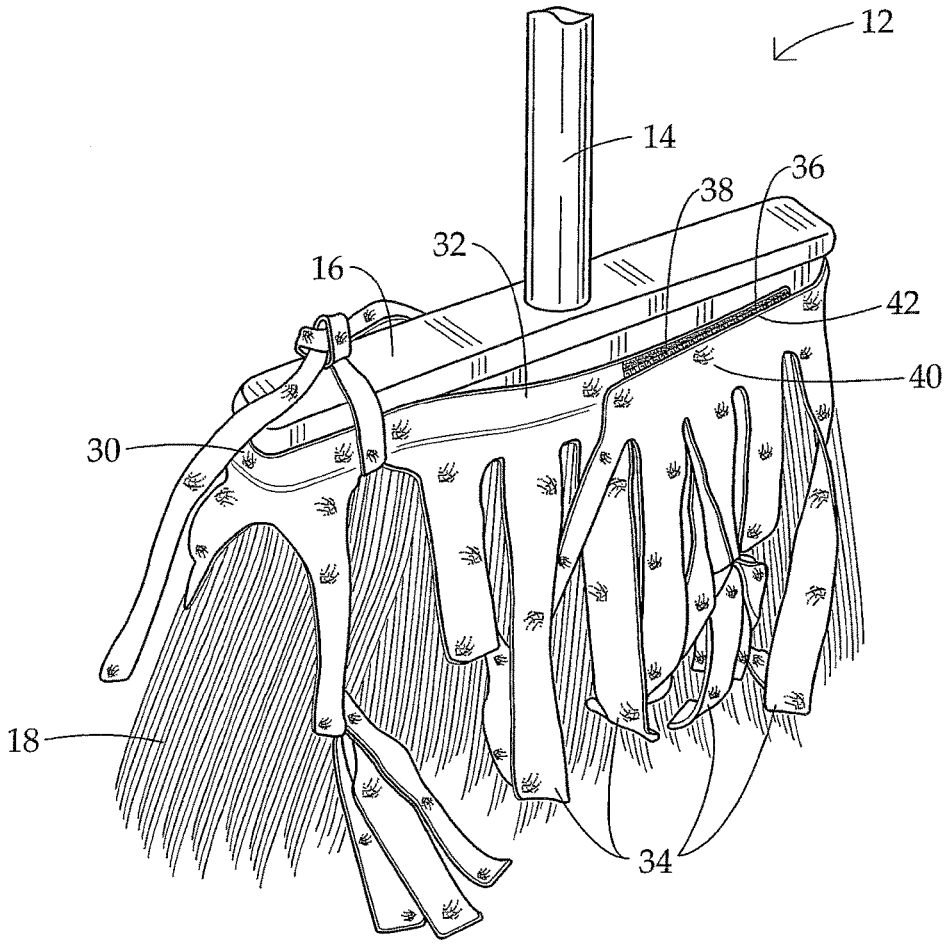
FIG. 1 is a perspective view of one side of a broom having an embodiment of the skirt applied to it.

While polar fleece is generally known as an apparel or blanket fabric, applicant has found that it makes a surprisingly good cleaning material, particularly when it is in a defined configuration and coupled with a broom. As seen in FIG. 1, a broom 12 has a typical handle 14 a head 16. A plurality of bristles 18 are mounted in the head 16 and deployed, typically fan shaped, out of the head 16. The top of the fanned out bristles results in a narrowing or notch below the head. Other broom shapes are known in which the head is more of a binding of the upper portions of the bristles into a consolidated mat. While brooms with synthetic bristles are preferred, natural straw bristles can also be used. The head 16 provides a rigid base for the bristles 18, so that upon movement of the head 16 by manipulation of the handle 14, the bristles 18 can be positioned as desired by the user, with good precision. The bristles can be borne against the floor and pressure applied, causing the bristles to be deformed. When that pressure is released, the bristles spring back to their normal shape and cause debris nearby to be impacted and thrown in the direction of the springing motion of the bristles.

The skirt 30 is shown in FIG. 1 as mounted on the head 16. The skirt 30 includes a yoke 32 having a first end 36 and a second end 40. The two ends 36 and 40 are provided with complementary hook and loop fasteners 38 and 42. The yoke 32 can be wrapped around the head 16 or upper portion of the bristles 18, and the hook and loop fasteners can be engaged with one another to cause the yoke 32 to snuggly surround the head 16. Integral with the yoke 32 is a plurality of depending strips 34. The strips 34 are intentionally made considerably longer than the bristles 18, so that when the skirt 30 is applied to the broom, the lower portions of the strips 34 come into contact with the floor underneath the bristles 18. In so doing, the broom is modified by having a new surface of polar fleece strips 34, providing it with a different surface characteristic. Particularly, the polar fleece strips 34 have been found to be very good at attracting and holding small and large pieces of dirt, adhering to them better than the bristles 18 do alone. Thus, the broom 12 with the skirt 30 applied can be used to reach dirt by positioning the strips 34 under control of the bristles 18, so the strips 34 pick up dirt better than the bristles 18. A complementary interaction of the stiff resilient bristles 18 and the flexible, movable strips 34 provide a unique cleaning capability that neither can attain on its own. This combination is very effective at removing dirt from the nooks and crannies of baseboard moldings.

Figure 2:
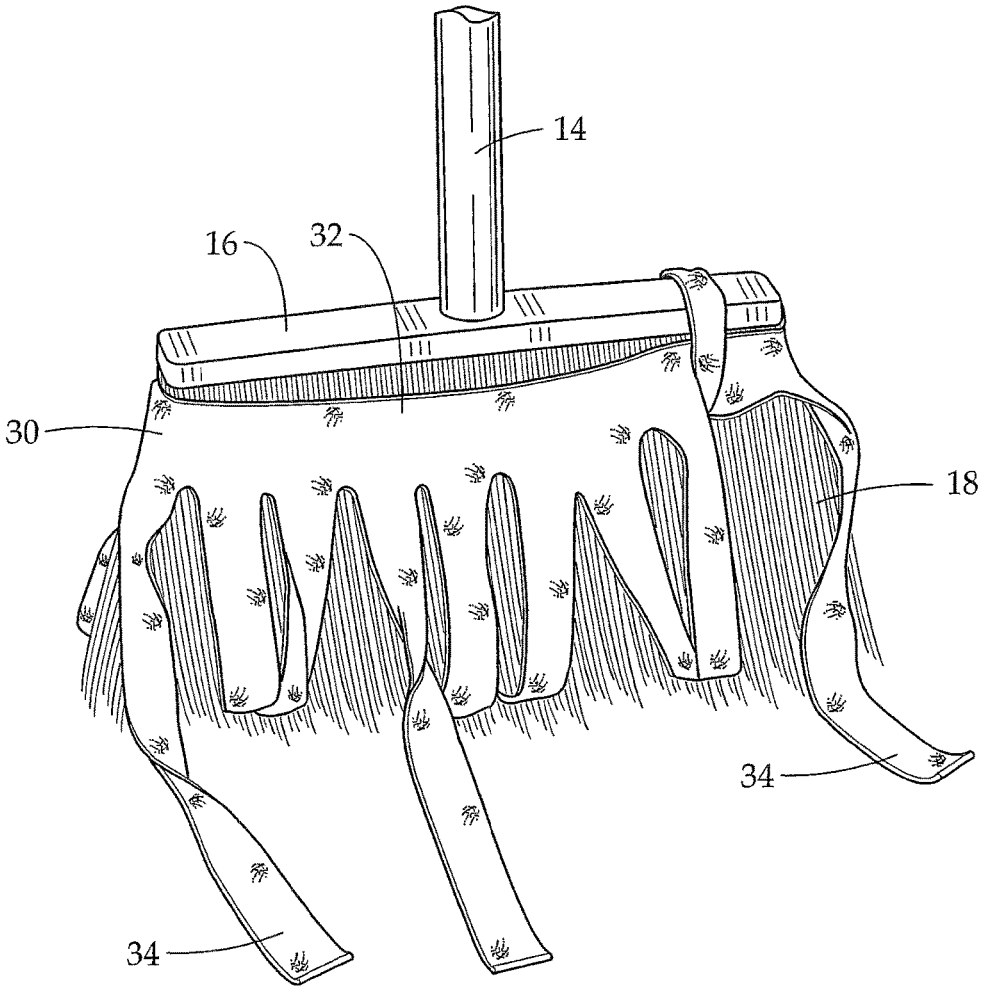
FIG. 2 is a perspective view from the other side of the broom and skirt of FIG. 1.

FIG. 2 shows the reverse side of the broom and skirt of FIG. 1, slightly modified. As seen, two of the strips can be threaded through the bristles and brought above the head 16 and tied as at 34 to provide additional securement of the skirt to the broom. In some embodiments such tying can be the way the skirt remains attached to the broom, dispensing with hook and loop or other fasteners around the head.

Figure 3:
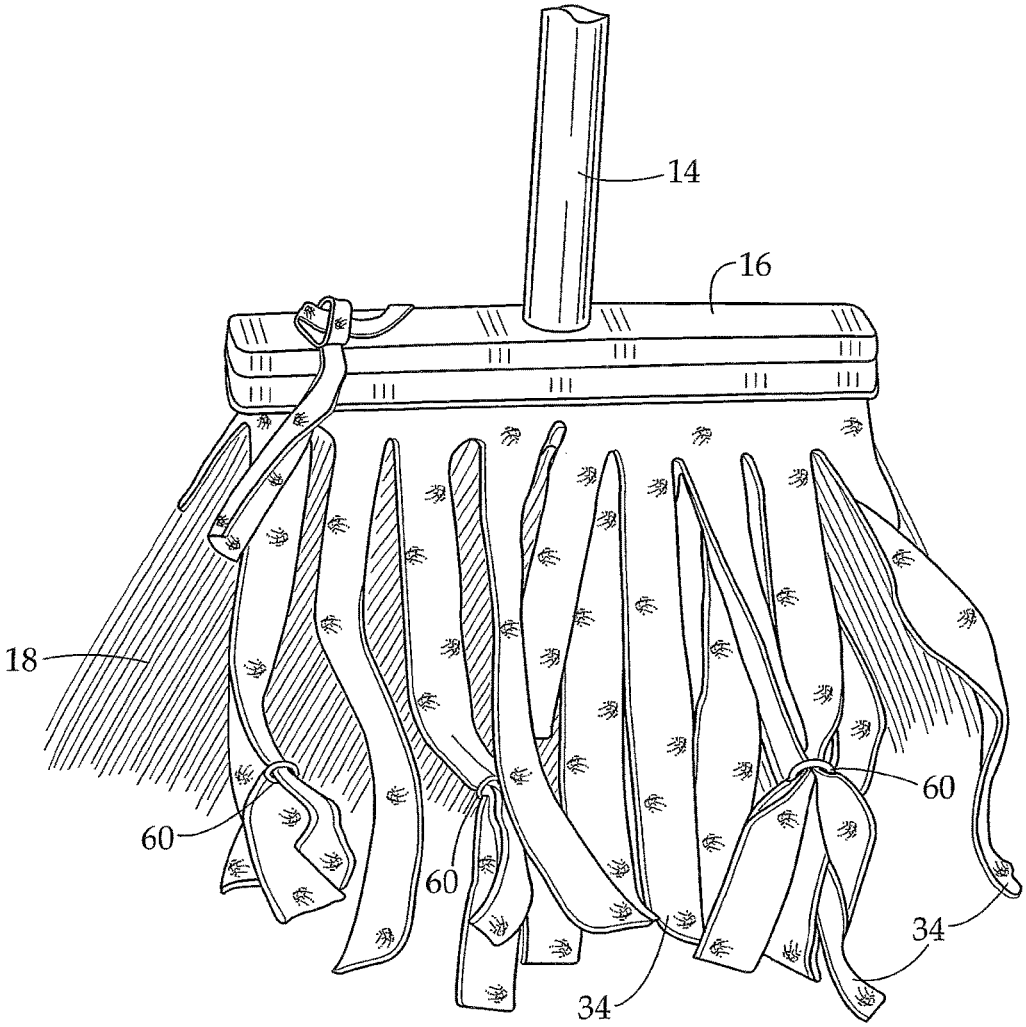
FIG. 3 is a perspective view of the broom and skirt of FIG. 1 with small bands applied.

FIG. 3 shows a further modification in which small rubber bands 60 are added. Several strips 34 from two opposing sides of the bristles can be threaded through the small rubber bands 60 and held together by the resilience of the rubber bands. By holding them in place at the end of the bristles 18, the strips are made to stay on the bottom end of the bristles. The thus-modified broom and skirt can then be used for cleaning overhead surfaces such as crown moldings and other high component, without having the strips fall back away from the bristles. This embodiment is also useful for cleaning tiles and grout lines in tiled walls such as shower walls. Other means for causing the strips from opposite sides of the bristles to be held together can also be used. For example, the strips may adhere to each other, such as with included hook and loop fasteners on the strips. Or, the strips could be knotted with one another. The skirted broom is also useful for cleaning grout on tiled floors.

Polar fleece typically has a stretchy direction and a non-stretchy direction that is transverse to the stretchy direction. Preferably the non-stretchy direction is parallel with the yoke, so that when fitting the yoke around the head the hook and loop fasteners can be snuggly positioned without additional regard for possible stretching. The stretchiness of the fabric in the strips is therefore substantially parallel with the length of the strips. The skirt can be made in lengths to go around the broom head more than once, providing additional cleaning strips. Indeed, since the perimeter length of the broom head can vary from broom to broom, a commercial embodiment is preferably made long enough to at least once encircle the largest broom head expected; when it is applied to a smaller broom head, there will be additional fabric to extend the wrap more than once around the head. To accommodate the resulting unpredictable number of wraps, the hook and loop or other fasteners can be sized and/or located to be able to fasten under any reasonably-expected number of wraps (or partial wraps). The yoke need not be applied to the head in all cases. The yoke could be wrapped around the top of the bristles, which form a narrowing or notch below the broom head, particularly when the head takes the form of a plastic or metal housing in which the bristles are anchored.

The entire skirt can be conveniently be made of a single piece of polar fleece fabric by simply cutting a rectangle having a length long enough to go around the head of the broom and fasten to itself and a width longer than the length of the bristles. In particular, it is desired that the width be great enough so that the strips extend at least one inch below the bristles. More preferred is for the strips to extend at least three inches below the bristles. The strips can be made to be even longer, and if the user finds them to be too long, the excess can be simply cut down to a desired size. The skirts can be made in various sizes to cooperate with various sizes of brooms.

The strips are formed in the rectangle by making a plurality of parallel cuts that extend from one side toward, but not all way to, the other side. The cuts need not be equally spaced; the result of unequal spacings being varying strip width, which is within the scope of the invention. The remaining, uncut portion forms the yoke of the skirt. Hook and loop fasteners can then be applied to the yoke of the skirt by sewing or other convenient means. Other fasteners such as a button/buttonhole, snaps, safety pins and the like can be substituted for the hook and loop fasteners. (In a less preferred form, polar fleece strips can be attached to a separate yoke component, such as by sewing or the like, with the yoke in that case not necessarily being polar fleece.)

In another embodiment, hook and loop fasteners can be used to removably mount the skirt to the broom. Either the hook or loop-type fastener component may be mounted to the broom head by an adhesive, with the other type of fastener attached to the yoke of the skirt, allowing removable attachment of the skirt to the yoke.

It is also within the scope of the invention if the skirt includes some strips that are not as long as others and therefore do not extend below the bottoms of the bristles.

Figure 4:
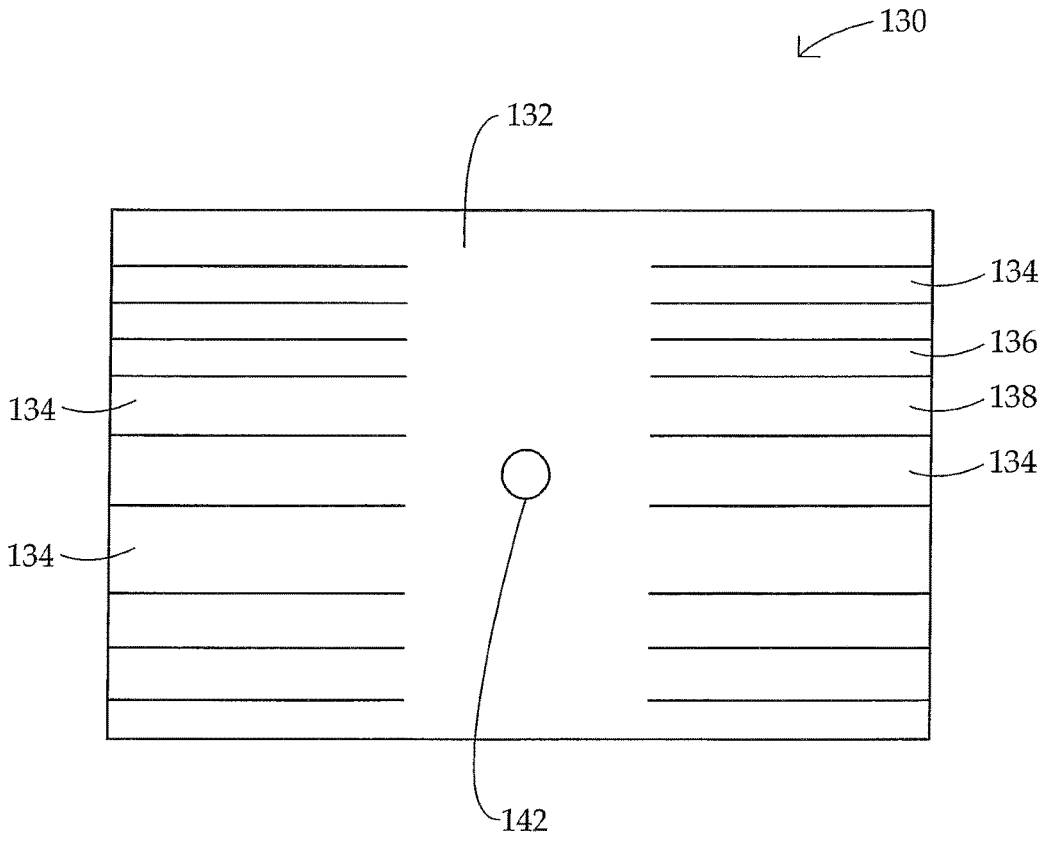
FIG. 4 is a plan view of another embodiment of the skirt, without the broom.

FIG. 4 shows another embodiment of the skirt 130, not yet mounted on a broom. Skirt 130 has a yoke 132, a plurality of strips 134 on either side, and a hole 142 at about the midpoint of the yoke. This embodiment can be made by starting with a rectangular piece of polar fleece, cutting into its opposed ends to form the strips, and cutting the hole 142. In use, the broom handle is slipped through the hole 142, the yoke 132 is brought to the top of the broom head, and the strips 134 are deployed on either side of the broom bristles. Selected ones of the strips can be passed through the bristles and tied over the top of the broom head, using the technique described above to secure the skirt 130 to the broom. FIG. 4 also shows that strips 136 and 138 can vary in width from others of the strips. This embodiment cleans well, also. To remove it from the broom, the strips are untied from above the head and the skirt is pulled up, withdrawing the broom handle from hole 142. If desired, other modes of securing the skirt 130 to the broom head can be used, such as tying around the side of the broom head.

In either embodiment, the resulting skirt is a low cost, light-weight, surprisingly effective addition to a broom. The strips work into nooks and crannies of areas to be cleaned by being directed by the bristles, providing better cleaning. The skirt can be used repeatedly. When it becomes excessively soiled, the skirt can be removed from the broom and laundered for reuse. The combination of skirt and broom is particularly effective on hardwood and other non-carpeted floors.

While the skirt works well in dry form, it can also be used moist. The polyester of the fabric does not instantaneously absorb as much water as cotton, so the broom with attached skirt can be dipped into a bucket of water to release soil from the skirt into the water with less uptake of water into the skirt than a cotton fabric would likely hold onto. The fabric can become either moist or wet, depending on how long the broom skirt is left in the water, and the moist or wet fabric can also be effective in picking up dirt and grime. The addition of the fleece to the broom extends the work time of the broom because it holds onto more dirt than the broom by itself because the bristles keep the cloth and dirt together. It is also believed to be extend the work time over a comparable mop, since the bristles help the fleece reach and "scour" adhering dirt. A broom alone cannot hold onto as much water or cleaner, nor can it pick up as much dirt as a cloth. Because the skirt is a lightweight polyester fabric, it requires less wringing than a regular mop head.

Additionally layers can be formed onto the skirt. In particularly, sponge and netting can be adhered by an adhesive, sewing or other means and provide a physical reinforcement for the polar fleece. This modification allows use in heavy duty situations such as cleaning outdoor concrete patios, stone decking, and similar coarser and/or abrasive surfaces.

The way the polyester fabric absorbs water, swells and releases the attached dirt when put into a bucket of water allows for a preferable cleaning tool than a traditional cotton mop that doesn't let go of dirt as well, or a sponge mop that doesn't pick up as much dirt. The polyester fabric does get wet, but polyester releases the water more rapidly than cotton when pulled out of bucket, so less wringing is needed. It can also be washed and sanitized, unlike a typical mop. Hospitals can use this product to retard the spread of germs.

In another mode of use, the floor can be sprayed with a diluted cleaner or water, and then worked with the skirted broom in the fashion of a conventional dry mop. This works really well, kind of like cleaning with a rag on hands and knees, and really fast too.

The combination of a dry or damp cloth with the action and force of broom bristles allows a wet and chunky spill or accident to be cleaned up easily.

In another mode of use, only the bottom part of cloth below the bristle line is wetted. That wetted cloth is used to clean. Then, the skirted broom is extended so more of the surface area of cloth (upper portions of strips and the yoke) touches floor, resulting in cleaning like using an extra cloth.

In another mode of use, the broom can be equipped with two of the skirts, which enhances the work power. The skirt can be made from a longer piece of fabric, such as a 40 inch wrap instead of a 30 inch, so the skirt can wrap the broom more than once.

Figure 5:
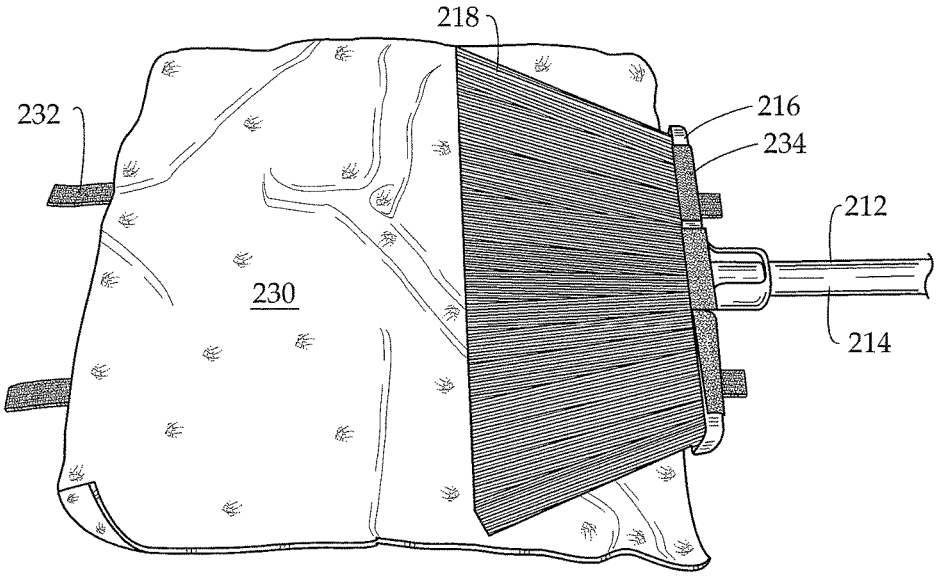
FIG. 5 is a plan view of another embodiment, with the fabric skirt laid out in preparation for connection to the broom.
Figure 6:
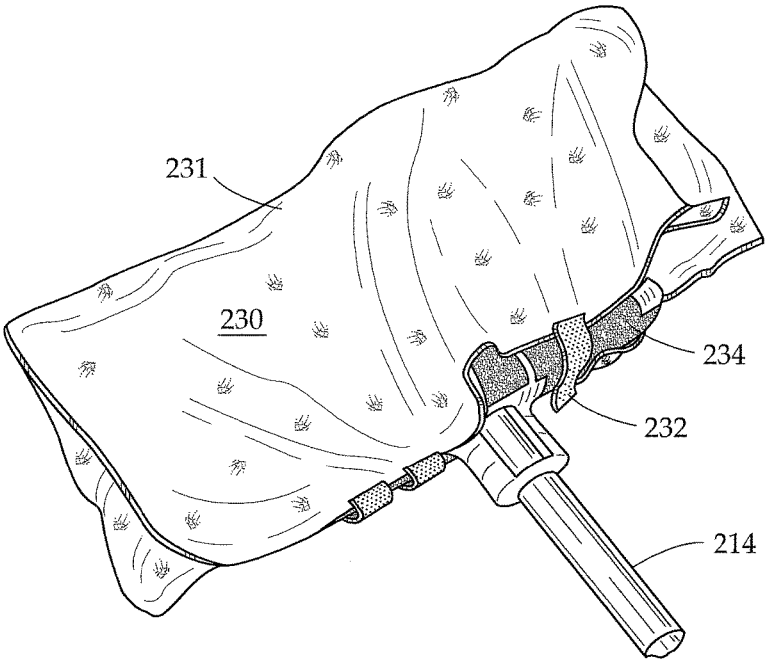
FIG. 6 is a plan view of the embodiment of FIG. 5 with the fabric skirt connected to the broom.
Figure 6A:
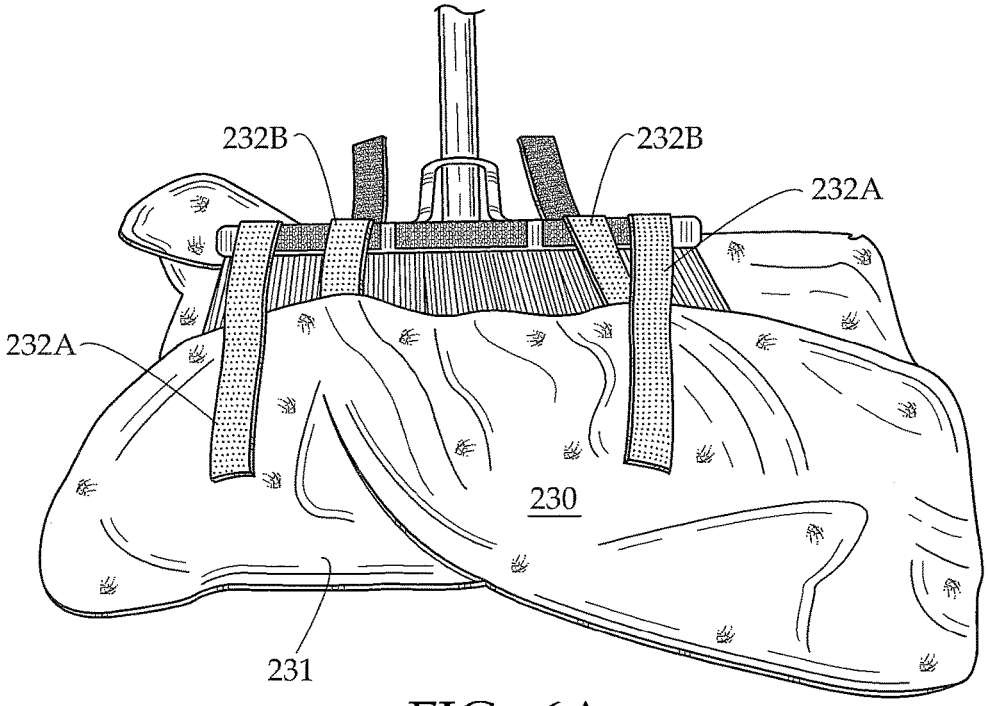
FIG. 6A is a plan view of a slightly different embodiment from FIG. 5 showing how longer connector strips allow the fabric skirt to be connected to the broom to provide a fresh fabric area to an action zone.

FIG. 5 shows a further embodiment of the broom and skirt. The skirt (230 in this instance) can wrap around the bristles 218 of the broom. The broom 212 has the conventional handle 214 and a broom head 216. The broom head 216 is provided with an array of hook-type hook and loop fasteners 234. The head is typically a plastic body having opposed sidewalls and a top wall. The hook-type connectors typically cover both of the opposed side walls, and may also cover the top wall, at least in substantial portion. The broad area of coverage of the hook-type fasteners allows a big target area for placement of loop-type connectors 232 sewn to the fabric 230. FIG. 6 shows the fabric wrapped around the bristles 218, so that the loop-type connectors 232 engage with the hook-type connectors 234 on the broom head. As seen, four of the loop-type strips 232 are shown in FIGS. 5 and 6, but other numbers of strips could be provided. They allow for the placement of the skirt on the bristles in numerous areas. In use, the ends of the bristles bear against the fabric 230 in an action zone 231, extending generally along the tips of the bristles. This action zone will be where most of the cleaning takes place, and the action zone of the fabric for any particular placement of the fabric on the broom will get dirtier than the rest of the fabric. As seen in FIG. 6A, by providing the loop-type connectors 232A in a longer configuration, the fabric 230 can be re-positioned on the broom relocating the fabric that had been in the action zone 231, and replacing it with other fabric. What was once a dirty area of the skirt thus is removed from the action zone, and a cleaner area of the skirt occupies the action zone. This allows primarily only clean fabric to be used in the cleaning process, for more effective cleaning. The strips 232A and 232B shown in FIG. 6A preferably extend at least 6 inches past the edge of the fabric, and more typically 7 inches, although a preferred size will depend in large part on the size of the broom head to be covered. Note in FIG. 6, the area of the fabric 230 is generally at least twice the area of the bristles 218, so that it can wrap on the broom bristles and cover both sides.

Figure 7:
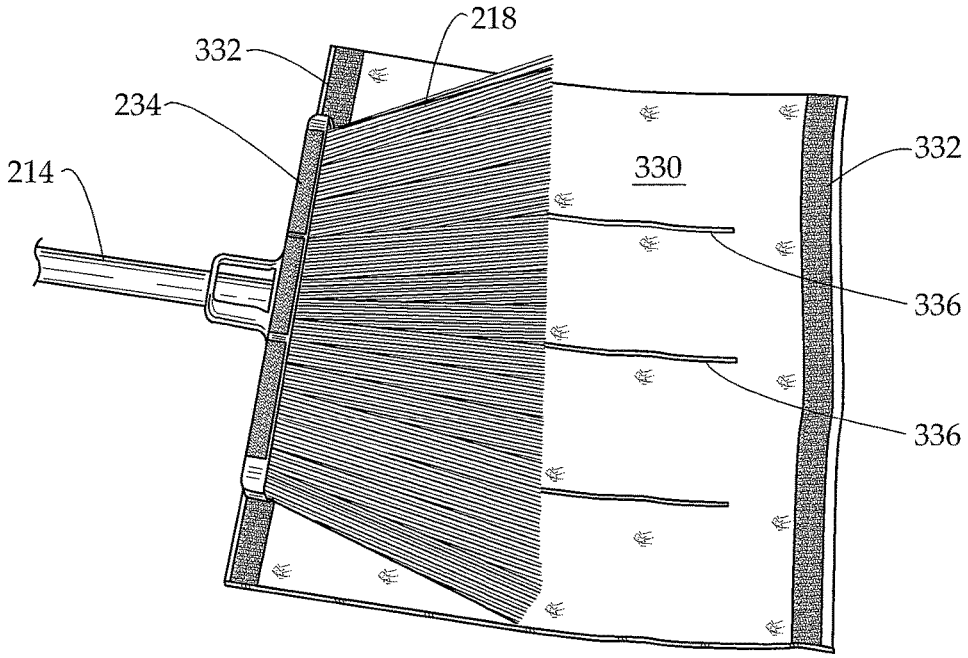
FIG. 7 is a plan view of another embodiment with the fabric skirt laid out in preparation for connection to the broom.

FIG. 7 shows a different embodiment of the skirt 330. This is a solid item of fabric of about the same size as for FIG. 6, but having strips 332 of loop-type connectors affixed to each opposing edge of the fabric skirt 330. The loop-type connector 332 can then connect with the hook-type connector 234 of the broom. The embodiment shown in FIG. 7 has slits 336 which allow more independent movement of portions of the fabric 330 with respect to the bristles.

Figure 8:
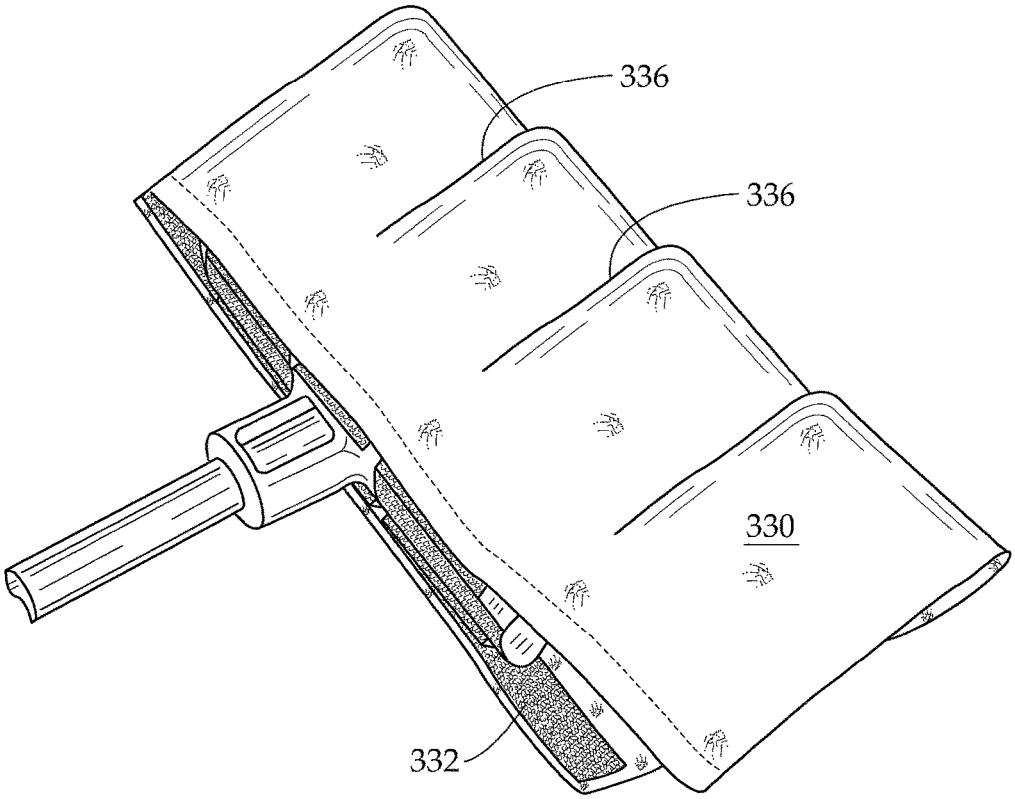
FIG. 8 is a plan view of the embodiment of FIG. 7 with the fabric connected to the broom.

FIG. 8 shows the fabric 330 wrapped onto the broom head and covering the bristles so that each of the two strips of loop-type connectors 332 shown in FIG. 7 engages with some of the hook-type connectors 234 of the broom head.

Figure 9:
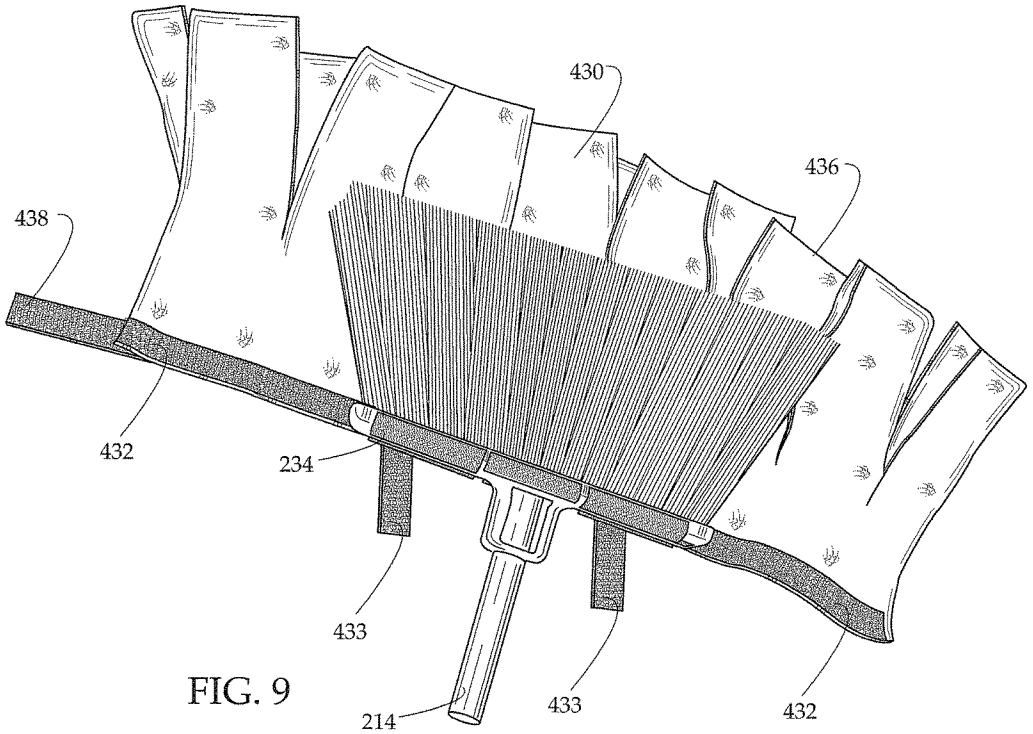
FIG. 9 is a plan view of another embodiment with the fabric skirt laid out in preparation for connection to the broom.
Figure 10:
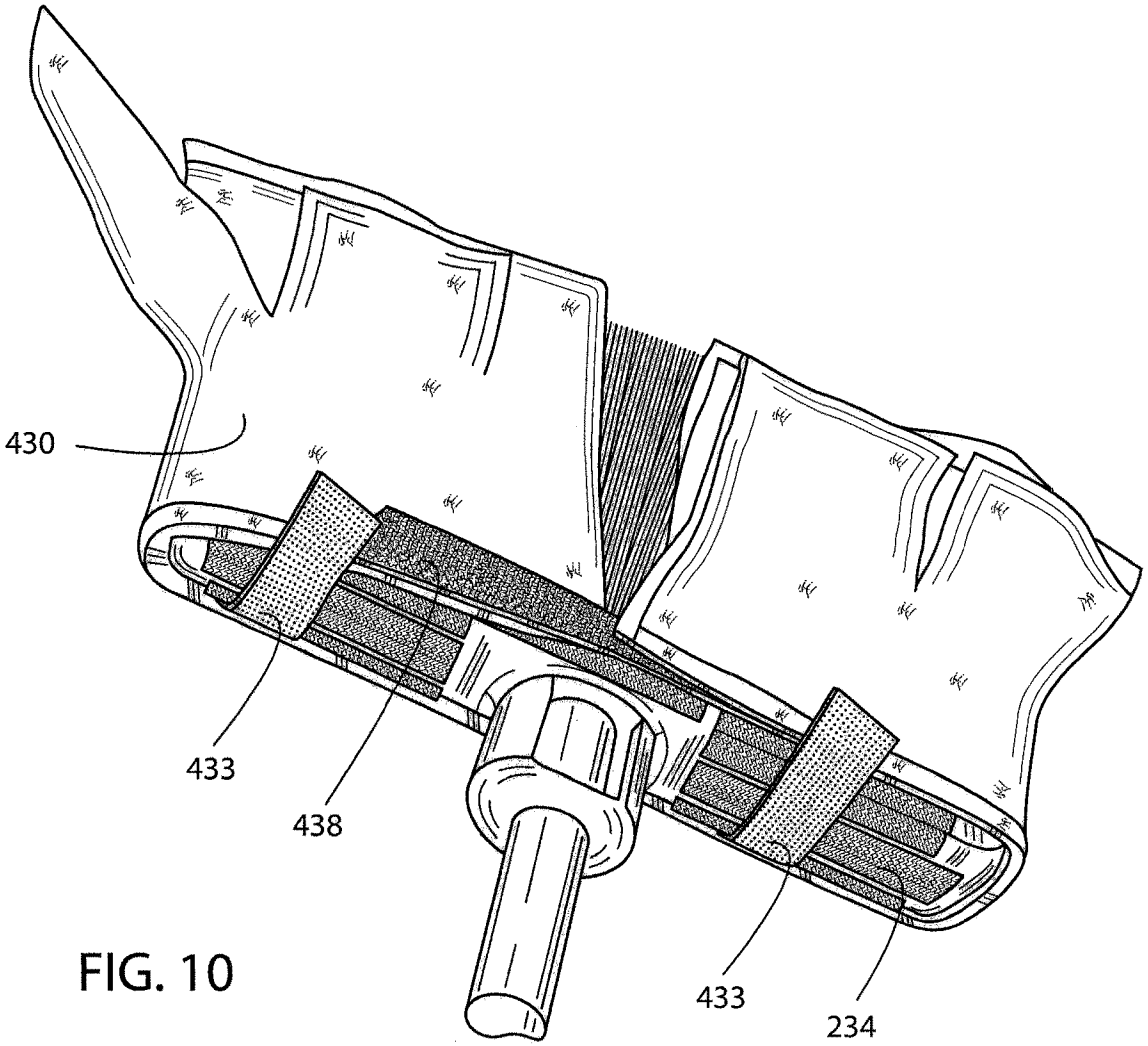
FIG. 10 is a plan view of the embodiment of FIG. 9 with the fabric connected to the broom.
Figure 11:
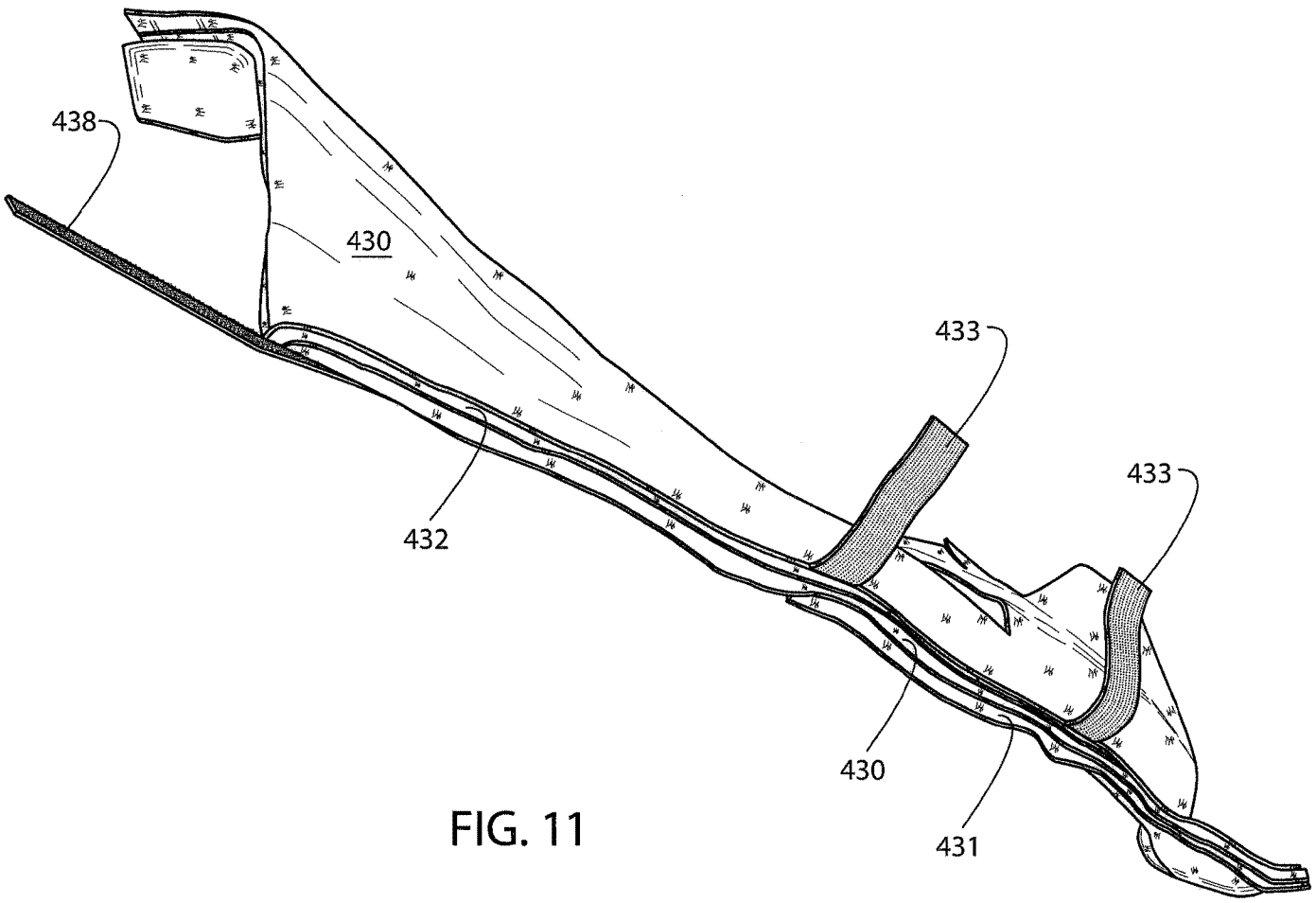
FIG. 11 is a top edge view of the skirt of the embodiment of FIG. 9.

FIG. 9 shows a further embodiment that wraps around the broom head. In this embodiment, the fabric is arrayed with a width wider than the broom head, so that it can wrap around the broom head. A loop-type connector 432 is stitched to one side of the fabric at a top edge and a hook-type connector 438 is affixed to the other side of the fabric and has portion protruding from one end, at the left as seen in FIG. 9. Additional loop-type strips 433 extend transversely from the fabric edge. The fabric skirt 430 is cut with a number of slits to form strips 436, as with the earlier embodiments. FIG. 10 shows the fabric skirt 430 wrapped on the broom head, with the loop-type connector 432 and 433 adhered to the hook-type connector 234 on the broom head, and hook-type connector 438 overlapping onto the fabric 430 to add to the strength of the connection. The strips 433 are shown wrapped over the head of the broom, so that connections can be made between the loops on the loop-type connector 433 and the hooks of hook-type connector on the head 234. The fabric 430 shown in FIGS. 9 and 10 is preferably provided in a two ply configuration, seen in more clearly in the edge view of FIG. 11. The two plies 430 and 431 are seen along with the loop-type connectors 432 and 433 and the hook-type connector 438.

Figure 12:
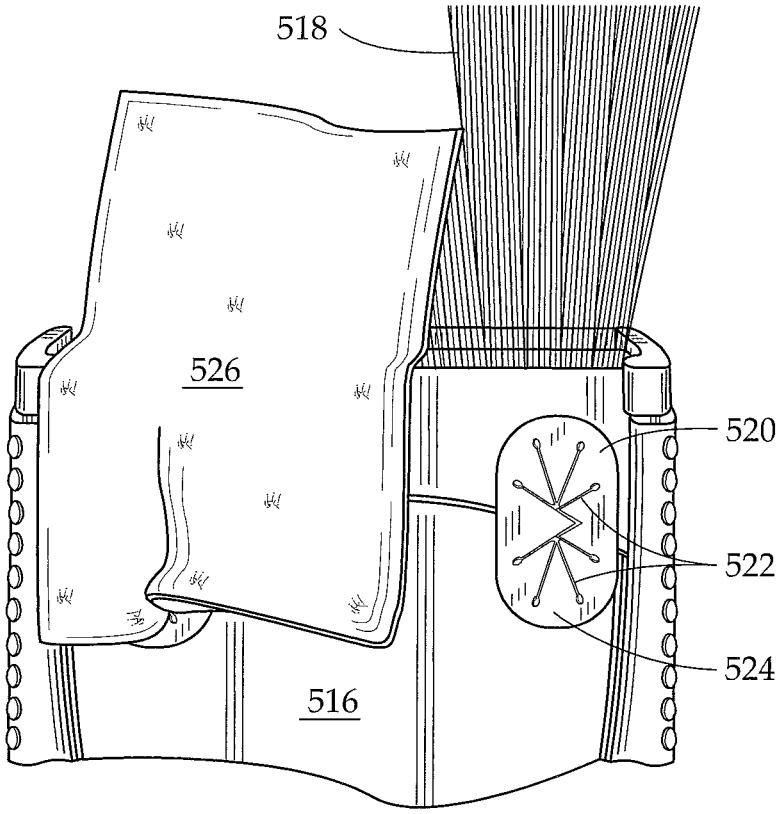
FIG. 12 is a side view of a broom head showing a different connector structure.

FIG. 12 shows a different broom head 516, with irregular cut grippers 520, like those found on conventional Swiffer cleaning products. One of the grippers is shown with a fabric 526 pressed into the grippers 520 to hold the edges. The other gripper is exposed, showing cuts 522 that define tabs 524. The pressed-in fabric 526 is engaged by friction and in part by points of the tabs 524 holding the fabric in place during normal use. When is it time to remove or reposition the fabric, it can be released from the gripper with a manual tug. For this type of head, the fabric need not have the loop-type connectors.

Other types of connectors can be used, such as snaps, clamps, zip-loc type connector or the like, as long as they provide a secure connection to the broom head during the cleaning process and enable easy removal and replacement. In addition, the plastic body of the broom head may be molded to have the hooks already, so no later addition of the tape is needed. If a Swiffer or other disposable type cloth is added to the broom with hook type material on the head, the clothe will adhere to the hook material without the addition of loop type material.

It is also desirable to make the broom handle telescoping to allow high spaces and nooks and crannies to be used with the cleaning device. It is also preferable to make the distal end of the broom handle curved like a vacuum cleaner handle for easier use by those with arthritis or other joint issues.

One of the benefits of the use of this configuration of a broom skirt on a broom is ease of use, particularly in comparison with a conventional floor mop (wet or dry). A mop that is conventional is harder to operate than a broom. The soft, pliable strings of a mop are so flexible that the end of the mop handle must be pushed onto the floor to achieve movement of the mop strings. This movement puts pressure on the user's joints, transmitted from the floor through the mop handle. Over time, this pressure can provide pain for the user. The springy bristles of the broom, when used with a skirt in accordance with the invention, provides cushioning, to spare hard impacts and pressure on the user's joints.

Numerous fabrics can be used, as long as they are selected to be able to attract and retain dirt. As noted, polar fleece is a good choice in many instances. Another good choice is a micro fiber terry cloth fabric made up of 52% biconstituent fiber (80% polyester and 20% nylon) and 48% polyester. An example is available as HDX brand towels from Home Depot, 2455 Paces Ferry Road, NW, Atlanta, Ga. 30339. Another useful fabric is a synthetic chamois made of 70% viscose and 30% synthetic. An example is available as Quickie Super Absorbent Towels, Quickie Mfg. Corp., P.O. Box 156, Cinnaminson, N.J. 08077.

The invention is considered to extend to not only the skirt, but also the broom modified to have connectors to be engaged with the fabric or other broom skirt.

Moreover, the invention can be practiced in kit form with a broom as described above and one or more sheets of a fabric as described above.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. A cleaning kit comprising a broom for use with a skirt formed from a fabric, the broom comprising a handle and a head with bristles extending from the head, the head defining a body with opposing sidewalls and a top wall, and a connector on the head comprising an array of hook-type hook and loop fasteners on the sidewalls and top wall, and at least one sheet of fabric having properties selected to be attractive to dirt, the fabric defining slits in a central area and having a size wider than the broom head and defining at least twice an area of one major face of the bristles of the broom, a fabric connector defining loop-type hook and loop fasteners complementary to the hook-type hook and loop fasteners on the broom head sidewalls and a top wall, the fabric further comprising a strip of material extending beyond an edge of the fabric with additional loop-type hook and loop fasteners complementary to the hook-type hook and loop fasteners on the broom head sidewalls and a top wall, the strip loop-type hook and loop fasteners extending along an edge of the fabric, whereby the fabric is fastened to the broom head by engagement of the loop-type hook and loop fasteners of the fabric to the hook-type hook and loop fasteners on one or more of the sidewalls and top walls of the broom head.

2. A cleaning kit as claimed in claim 1 wherein the loop-type connectors are positioned in a strip extending beyond an edge of the fabric by at least 6 inches, permitting connection of the loop-type connector to the hook-type connector on the broom head at a variety of positions, enabling positioning of a variety of parts of the fabric at bristle ends.

3. A cleaning kit as claimed in claim 1 wherein the fabric is predominantly four-sided and the loop-type connector extends over areas along opposite edges of the fabric.

4. A cleaning kit as claimed in claim 1 wherein the fabric is two-ply.

5. A cleaning kit as claimed in claim 1 wherein a strip of hook-type connector extends from one end of the fabric on an opposite side from the loop-type connector strip that extend along and edge of the fabric, so that when the skirt is wrapped on the broom head, the hook-type connector on the skirt can connect with the loop-type connector on the fabric edge.

6. A cleaning kit as claimed in claim 1 wherein the fabric is selected from the group consisting of polar fleece, a microfiber terrycloth fabric made of 52% biconstituent Fiber (80% polyester, 20% nylon) and 48% polyester, and a synthetic chamois made of 70% viscose and 30% synthetic.

7. A cleaning kit as claimed in claim 1 wherein the head is a plastic body defining the opposing sidewalls and the top wall, whereby the fabric and strip are both fastened to the broom head by engagement of the respective loop-type hook and loop fasteners of the fabric to the hook-type hook and loop fasteners on the broom head sidewalls and top wall.

* * * * *